US005538455A

United States Patent [19]

James, II

[11] Patent Number: 5,538,455

[45] Date of Patent: Jul. 23, 1996

[54] MULTI-COLOR BATON

[75] Inventor: Richard T. James, II, Duncansville, Pa.

[73] Assignee: James Industries, Inc., Hollidaysburg, Pa.

[21] Appl. No.: 491,115

[22] Filed: Jun. 16, 1995

[51] Int. Cl.[6] ..... A63H 33/22

[52] U.S. Cl. ..... 446/236; 446/243; 446/267; 40/406; 434/102

[58] Field of Search ..... 446/166, 236, 446/243, 267, 491; 273/67 R; 40/406, 409, 414, 660; D21/100; 282/109; 84/477 B; 434/98, 101–104, 126

[56] References Cited

U.S. PATENT DOCUMENTS

| | | | |
|---|---|---|---|
| 1,556,511 | 10/1925 | Dobbins | 40/406 |
| 2,741,693 | 4/1956 | Fasson | 40/406 |
| 2,752,725 | 7/1956 | Unsworth | 446/166 |
| 3,918,708 | 11/1975 | Augusta | 446/243 |
| 3,964,189 | 6/1976 | Belokin | 40/414 |
| 4,106,079 | 8/1978 | Drury . | |
| 4,208,701 | 6/1980 | Schock . | |
| 4,600,974 | 7/1986 | Lew et al. | 362/102 |
| 5,092,807 | 3/1992 | Lew et al. | 446/267 |
| 5,299,938 | 4/1994 | Waltho | 434/126 |
| 5,426,877 | 6/1995 | Lin | 40/406 |
| 5,452,889 | 9/1995 | Lewinski | 273/67 R |

FOREIGN PATENT DOCUMENTS

| | | |
|---|---|---|
| 1211877 | 12/1958 | France . |

*Primary Examiner*—Robert A. Hafer
*Assistant Examiner*—Jeffrey D. Carlson
*Attorney, Agent, or Firm*—Howson and Howson

[57] ABSTRACT

A multi-colored twirling baton comprising a transparent tube having a transparent helical partition co-axially extending through the tube to form two separate helical fluid chambers. Two light-transmissive fluids of different colors fill respective ones of the chambers. Light transmitted through the baton displays a helical array of the two colors and a third color which is a blend of the other two.

5 Claims, 1 Drawing Sheet

MULTI-COLOR BATON

FIELD OF THE INVENTION

The present invention relates generally to improvements in batons, wands, canes and the like, and more particularly to a novel multi-colored twirling baton.

BACKGROUND OF THE INVENTION

Twirling batons are frequently decorated in colorful and attractive patterns for visual enhancement. Typically, brightly colored and reflective particles are applied on the surface of the baton or in a fluid contained within a transparent hollow tube. For example, U.S. Pat. No. 5,092,807 to Lew et al. discloses a baton consisting of a transparent tube filled with light-reflecting particles suspended in a fluid medium and light-reflecting helically twisted ribbons extending end-to-end through the fluid. The colors visible in the baton correspond to the colors of the fluid and the reflecting surfaces of the particles and ribbons in the tube.

While the Lew baton may function satisfactorily for its intended purpose, there is a continued demand for novel batons which display attractive colors statically and dynamically without requiring additional visual enhancements such as reflective particles.

OBJECTS OF THE INVENTION

With the foregoing in mind, an object of the present invention is to provide a novel decorative twirling baton which displays an attractive and fascinating combination of different colors along its length when viewed statically and dynamically.

Another object of the invention is to provide a twirling baton displaying a unique array of three different colors derived from a combination of two of the colors.

Still another object is to provide a novel twirling baton which, in rotation about its longitudinal axis, produces a striking dynamic display of colors along the length of the baton.

A further object of the invention is to provide a multi-colored baton which is constructed of conventional comparatively safe materials, and which is inexpensive to manufacture.

SUMMARY OF THE INVENTION

Briefly, these and other objects and novel features of the twirling baton according to the invention are achieved with an attractive arrangement of colored fluids contained in adjacent helically-elongate chambers. The baton comprises an optically-clear helical partition or ribbon extending through the length of an optically-transparent tube to form two separate helical chambers. The chambers are filled with light-transmissive fluids of two different colors, preferably complementary to each other. Caps at opposite ends of the tube permanently seal the fluids within the chambers. When viewed from one side of the tube with back-lighting, the two fluids act as filters to transmit, in discrete segments, the two fluid colors as well as a third color which is a chromatic blending of other two. The baton displays an attractive arrangement of colors when held statically or when manipulated.

Other objects, features and advantages of the invention will become apparent from the following detailed description of the invention when considered in conjunction with the accompanying drawings.

DESCRIPTION OF THE PREFERRED EMBODIMENT

Figure 1:
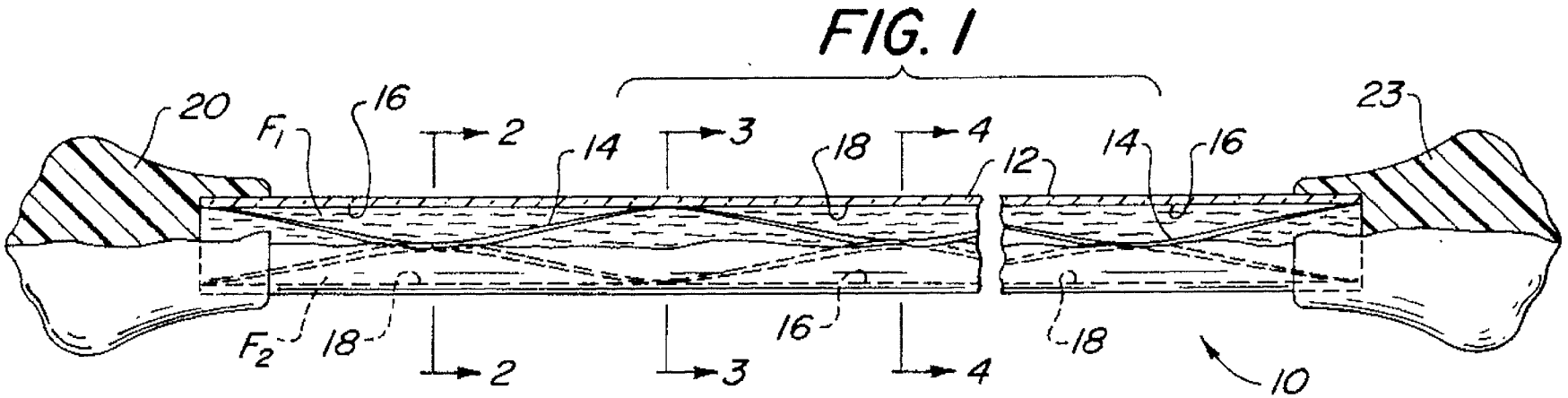
FIG. 1 represents in partial longitudinal cross-sectional view a twirling baton according to the invention.

Referring now to the drawings wherein like reference characters denote like or corresponding parts throughout the several views, FIG. 1 illustrates a twirling baton 10 according to the invention. The baton 10 comprises a straight and slender optically transparent, or clear, tube 12 with a helically twisted optically transparent, or clear, partition 14 extending through the tube and contiguously connected along opposite ones of its respective edges to diametrically opposite helical inner surfaces of the tube. The partition cooperates with the tube 12 to define two separate helically-elongate chambers 16 and 18 sealed from each other along their lengths, and sealed at opposite ends of tube 12 by bulbous end caps 20 and 22. Tube 12 and partition 14 are preferably constructed of a hard and durable plastic which may be formed integrally by co-extrusion, or other suitable processes.

Figure 4:
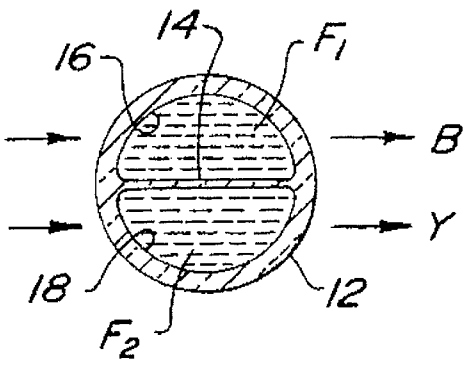
FIG. 2, 3 and 4 are transverse cross-sectional views of the baton of FIG. 1 taken respectively along the lines 2—2, 3—3 and 4—4.
Figure 3:
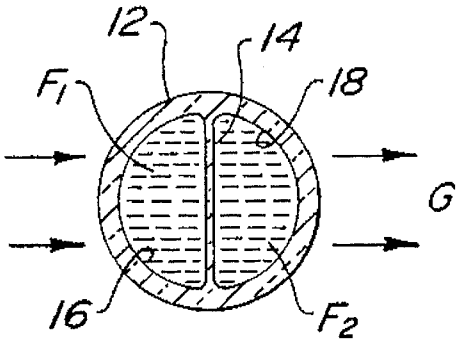
Figure 2:
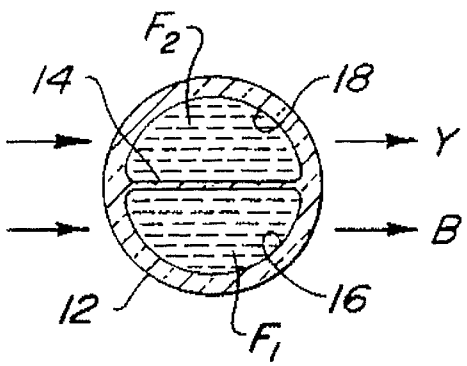

Chambers 16 and 18 are filled with light transmissive fluids $F_1$ and $F_2$ of different colors, preferably complementary, so that chromatic blending the two in appropriate proportions yields a third discrete color. For instance, light transmitted serially through a blue fluid in chamber 16 and a yellow fluid in chamber 18 laterally through the baton 10 produces a green color. This is schematically illustrated in FIGS. 2, 3 and 4. In FIG. 2, parallel light rays emitted from fluids $F_1$ and $F_2$ are blue and yellow, respectively, and in FIG. 3, the emitted light from the combined fluids $F_1$ and $F_2$ is green. FIG. 4 illustrates the inversion of channels 16 and 18 from their position in FIG. 2, thereby providing a decorative array along the length of the baton of alternating blue and yellow colors on either side of the green as shown in FIG. 1.

A colored fluid suitable for use in channels 16 and 18 is any nontoxic dye in pure water.

Statically, the baton 10 displays a helical image of three discrete colors through the tube 12. Rotating the tube 12 about its long axis produces a barber pole-like illusion of three colors traveling through the tube into either end cap.

Some of the many advantages of the twirling baton of the present invention should be readily apparent. For example, a single helical member in a transparent tube divides the tube lengthwise into two helical channels containing two different colors which chromatically combine to form a third color in the tube. Such a color arrangement when static or in motion is pleasing to the eye and especially attractive and fascinating.

It will be understood, of course, that various changes in details, materials, steps and arrangement of parts, which have been herein described and illustrated in order to explain the nature of the invention, may be made by those skilled in the art within the principle and scope of the invention as expressed in the appended claims.

I claim:

1. A multi-colored baton comprising, in combination:

an elongate tube of optically transparent material defining two contiguous helical chambers sealed from each other along the lengths thereof;

caps sealingly fixed to opposite ends of said tube; and a fluid contained in each of said chambers, said fluid in one chamber having light transmissivity of a color different from the color of the fluid in the other chamber.

2. A multi-colored baton according to claim 1 wherein said tube comprises:

a helical partition extending through said tube and contiguously secured along opposite edges to diametrically opposed helical surfaces in said tube for sealing said chambers from one another.

3. A multi-colored baton according to claim 1 wherein the colors of said fluids are complementary to each other so as to form a third color when the baton is viewed laterally.

4. A multi-colored twirling baton comprising, in combination:

an optically-transparent tube;

an optically-transparent helically twisted partition coaxially extending through said tube and forming two separate helical chambers;

said partition being sealingly secured along opposite edges thereof to diametrically opposed helical surfaces in said tube;

a cap sealing each end of said chambers; and a fluid contained within each of said chambers for passing light of respectively different colors, the colors of said fluids being complementary to each other.

5. A multi-colored baton, comprising:

an elongate tube of optically-transparent material, an optically-transparent helical partition extending lengthwise of said tube dividing said tube into a pair of separate helical fluid chambers, a first fluid contained in one of said fluid chambers and a second fluid contained in the other of said fluid chambers, said first fluid and said second fluid being of different optically translucent chromatically-complementary colors, said partition and said tube being coextruded of clear plastic and sealed at opposite ends after said fluid chambers are filled with said fluids, whereby the colors of the fluid combine when light passes through the baton to provide an aesthetically pleasing chromatic effect in static and dynamic positions of the baton.

* * * * *